US005660373A

United States Patent [19]

Maslo et al.

[11] Patent Number: 5,660,373

[45] Date of Patent: Aug. 26, 1997

[54] EXTENDABLE AND RETRACTABLE LIFTING APPARATUS

[75] Inventors: Karl Maslo, Neukeferloh; Dieter Hein; Leonhard Jaumann, both of Munich, all of Germany

[73] Assignee: Sachtler-Aktiengesellschaft-Kommunikationstechnik-Unterschlessheim, Germany

[21] Appl. No.: 398,282

[22] Filed: Mar. 3, 1995

[30] Foreign Application Priority Data

Mar. 4, 1994 [DE] Germany ..... 44 07 265.1

[51] Int. Cl.[6] ..... B66D 1/00

[52] U.S. Cl. ..... 254/296; 254/343

[58] Field of Search ..... 254/296, 343, 254/362

[56] References Cited

U.S. PATENT DOCUMENTS

| | | | |
|---|---|---|---|
| 897,560 | 9/1908 | Stosick | 254/296 |
| 1,352,455 | 9/1920 | Johnston | 254/296 |
| 2,768,757 | 10/1956 | Barry | 254/296 |
| 5,261,645 | 11/1993 | Huffman | 254/267 |
| 5,366,203 | 11/1994 | Huffman | 254/362 |

FOREIGN PATENT DOCUMENTS

| | | |
|---|---|---|
| 2418414 | 9/1979 | France . |
| 2083433 | 3/1982 | United Kingdom . |
| 2225308 | 5/1990 | United Kingdom . |

*Primary Examiner*—Katherine Matecki
*Attorney, Agent, or Firm*—Dilworth & Barrese

[57] ABSTRACT

The invention relates to a lifting apparatus with a carrying part (16, 18) which is connected via a cable (22) or the like with an actuating part for adjustment of the vertical position of the carrying part, in particular by means of interconnection of a pantograph (10), the actuating part comprising an actuating device with a gear transmission of which one transmission part, under the influence of the load of the carrying part (16, 18) or a load hanging from this, exerts a force on the other transmission part which couples this transmission part with an actuating element against a restoring force, wherein, upon actuation for the lifting of the carrying part (16, 18) out of the position in which the one transmission part does not exert any force on the other transmission part, the latter is moveable again into coupling engagement by means of the actuating element.

10 Claims, 4 Drawing Sheets

Fig. 1
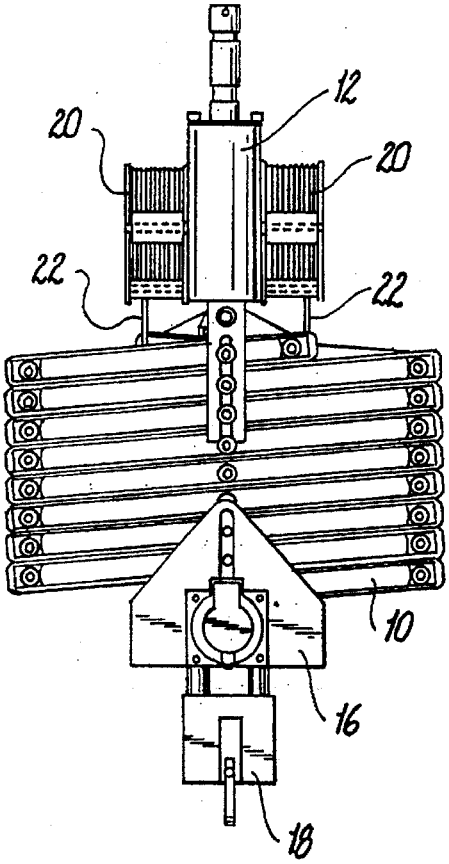
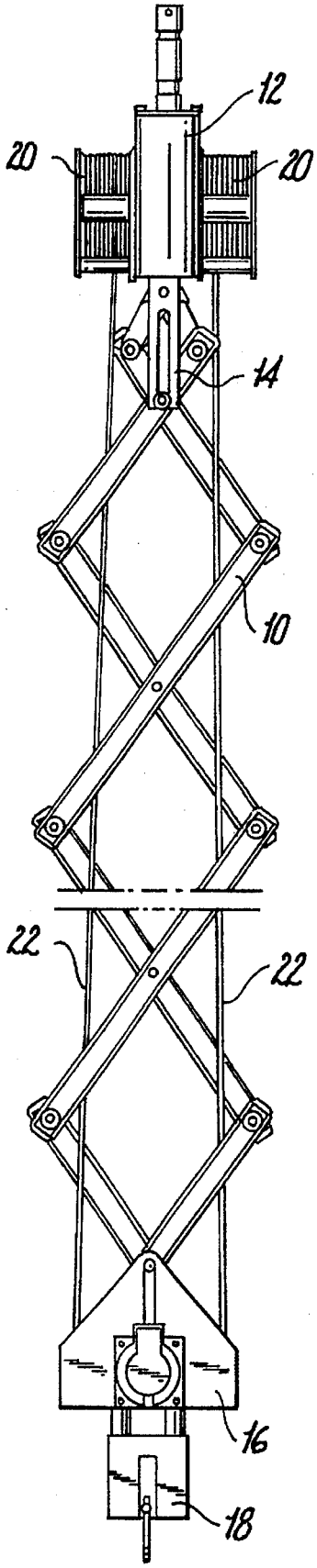
Fig. 2

EXTENDABLE AND RETRACTABLE LIFTING APPARATUS

BACKGROUND OF THE INVENTION

The invention relates to a lifting apparatus, and in particular to a lifting apparatus which is actuated purely mechanically and operated with a cable or the like.

When a lifting apparatus is operated with a cable which is arranged between an actuating part and a carrying part, then there exists the problem that when the carrying part or the load hanging from this strikes an obstruction upon being lowered and the cable continues to be actuated, the cable would pass out of the normal taut cable state into an undesirable slack cable state with the consequence that the cable can become snagged in neighbouring structural parts. This would result in an inevitable faulty operation of the lifting apparatus.

SUMMARY OF THE INVENTION

It is therefore the object of the invention to design a lifting apparatus with a cable or the like to the extent that it can be prevented in a particularly simple and operationally safe manner in connection with a compact structure that the afore-mentioned slack cable state arises.

This object is solved in a lifting apparatus with a carrying part connected with an actuating part by means of a cable or the like for adjustment of its vertical position, in particular by way of interconnection of a so-called pantograph, in that the actuating part comprises an actuating device with a gear transmission of which one transmission part exerts under the influence of the load of the carrying part or a load hanging from this a force on the other transmission part which couples this transmission part against a restoring force with an actuating element, wherein, upon actuation for lifting the carrying part out of the position in which the one transmission part does not exert any force on the other transmission part, the latter is moveable again into coupling engagement by means of the actuating element.

By way of such a solution, the afore-mentioned object can be elegantly solved in a particularly simple and, especially, purely mechanical manner. In particular, this allows a compact mode of construction to be achieved.

This is particularly also the case when the one transmission part is a worm gear connected with at least one hoisting-cable drum and the other transmission part is connected with the actuator, on account of which it is additionally ensured that a stable lifting position is always achievable through automatic locking.

According to an advantageous embodiment, the actuating element has on the driven side a part of a coupling and the worm gear has the other part of the coupling. In this case, the actuating element can be a drive shaft upon which the worm gear is rotatably and axially displaceably supported. On the side of the worm gear opposite the coupling, the worm gear rotatably holds a pawl which lies with its free end against the drive shaft in such a manner that this goes into abutment with a stop arranged on the drive shaft upon rotation of the drive shaft to lift the load and couples the worm gear with the drive shaft and, upon a relative rotation of the drive shaft in the opposite direction, passes over the stop in a manner of a ratchet. In order that a problem-free synchronous recoupling is possible, the one and other parts of the coupling lie approximately at the same level in the axial direction as the stop located on the drive shaft.

In order to relieve the load from the pawl upon lifting the load, during the coupling of the coupling, the worm gear carries out such a small rotation about its axis that the pawl is separated from the stop.

BRIEF DESCRIPTION OF THE DRAWINGS

The invention is described in more detail in the following with reference to exemplary embodiments purely schematically shown in the drawings, in which:

FIG. 1 shows a side view of a cable pantograph in the retracted state;

FIG. 2 shows a side view of the cable pantograph according to FIG. 1 in the extended state;

DESCRIPTION OF THE PREFERRED EMBODIMENTS

Figure 3:
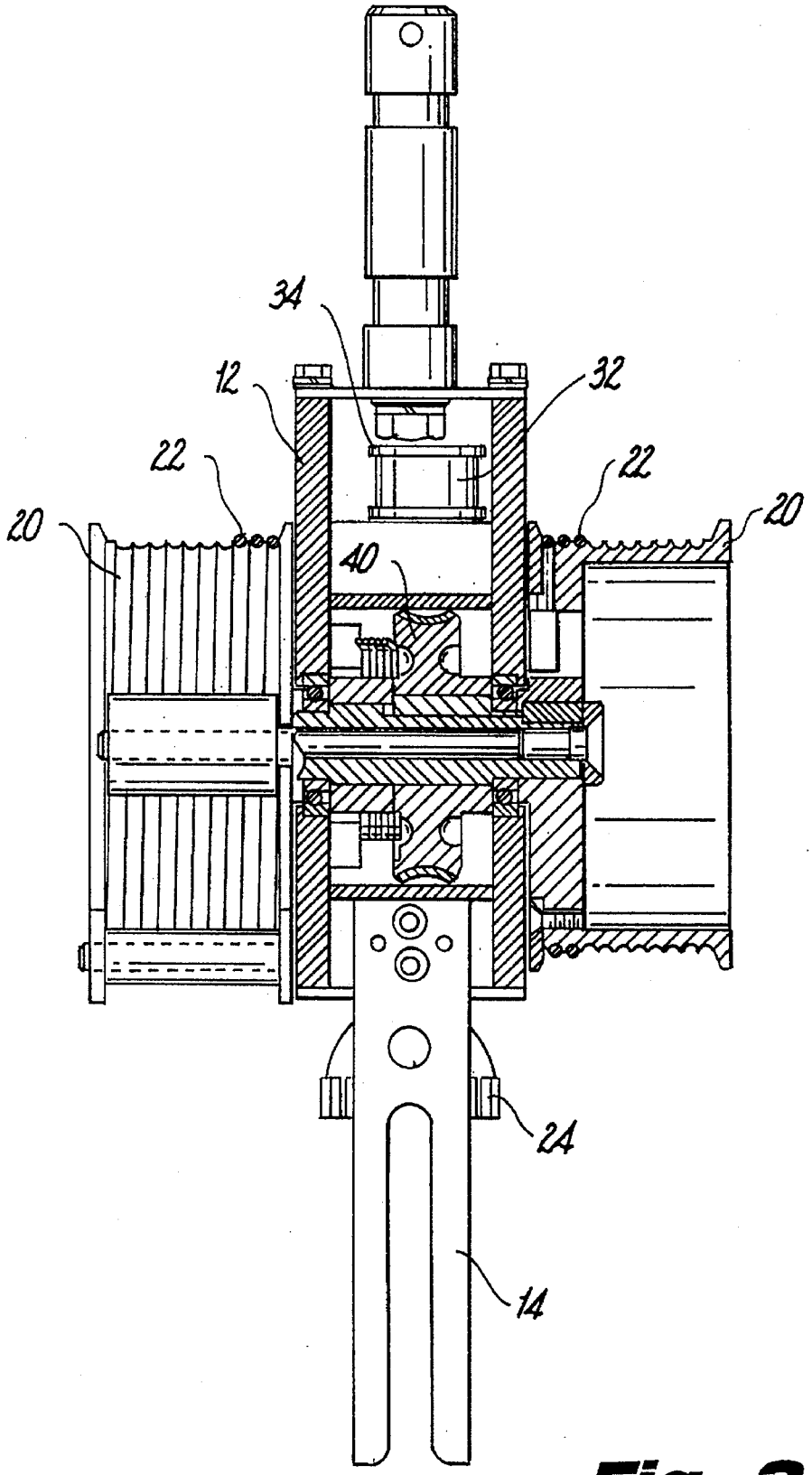
FIG. 3 shows a view of the cable drive illustrated in partial cross-section.

The cable pantograph shown in FIGS. 1 and 2 as a lifting apparatus respectively in the retracted and extended states consists of a mechanical pantograph linkage 10 which is secured via its upper end 14 to the lower end of an actuator housing 12. A load hook 18 is located at the lower end 16 of the pantograph linkage. Cable drums 20 from which a carrying cable 22 respectively extends are arranged to each side of the housing 12. The lower end of both of these carrying cables is connected with the lower end 16 of the pantograph linkage 10. If the cable drive was not present, the cable pantograph could either be pulled down into the end position shown in FIG. 2, or into all possible intermediate positions, for example, when one pulls downwardly on the cable pantograph at its load hook 18 out of the position thereof illustrated in FIG. 1. Here this pantograph is still connected with a cable drive although the cable drive could also operate without the pantograph. When the lower end 16 of the pantograph linkage with the load hook 18 moves downwards and in this case this lower end or any other part of the pantograph linkage or a load hanging from the load hook 18 strikes an obstruction and the cable drive is to be continued, then the cables 22 can increasingly pass into a slack cable state for as long as the cable drive is continued. This would have the result that the cables could catch in the pantograph linkage with the results of a hindrance of the restart of the lifting process. It is therefore to be ensured that the cables are at all times in a taut cable state as, for example, illustrated in FIG. 2.

Figure 4:
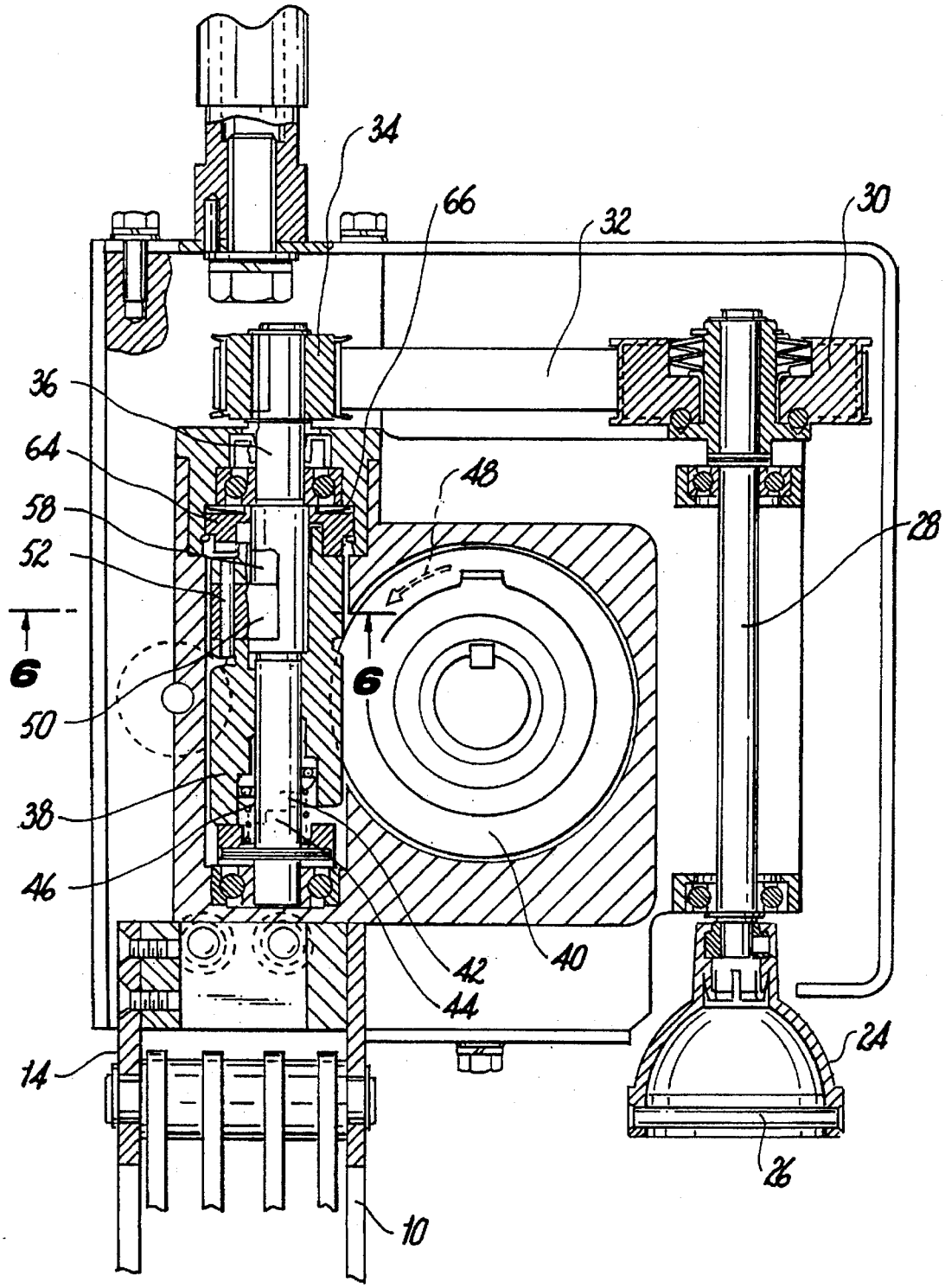
FIG. 4 show a view of the cable drive illustrated in partial longitudinal section.

In accordance with FIG. 4, the actuator consists, for example, of the following essential parts: a bell or socket 24, which is provided with a transverse pin 26, a drive shaft 28 connected to this without relative rotation and connected in turn without relative rotation at its end opposite the bell 24 with a belt pulley 30, a drive belt 32, a further belt pulley 34 which is arranged without relative rotation on a further drive shaft or actuator element 36, a worm 38 seated on this drive shaft 36 and a worm gear 40 in engagement with this and which is connected without relative rotation to both of the cable drums 20. Details of this drive or actuator are also apparent from FIG. 3.

The worm 38 is arranged in an axially displaceable manner on the drive shaft 36 and has at its lower end as illustrated in FIG. 4 a coupling part 42 which can be, for example, part of a jaw clutch or part of a pin-type coupling or also any other desirable coupling. As illustrated in FIG. 4, the drive shaft 36 is provided at its lower end with another complementary coupling part 44. A spring 46 normally presses both coupling parts apart in such a manner that the worm 38 is located in its upper position as shown in the illustration of FIG. 4. This is depicted in FIG. 4 in the right-hand half of the sectional view of the drive shaft. In the left-hand half, the coupling state between the coupling parts is shown. In this position, the spring 46 is in the compressed state and the worm gear 38 is illustrated in its lower position.

In the taut cable position, in other words the position in which the cables 22 are held taut under a load, the cables 22 exert a twisting moment on the worm gear 40 in the direction of the arrow 48 in FIG. 4 with the result that this twisting moment is transferred to the worm 38 to the extent that the worm 38 is moved axially into the mentioned coupling engagement. When the drive shaft 36 is then rotated via the bell 24, the drive shaft 28 and the pulley 32, the coupling part 44 securely connected to the drive shaft 36 is also rotated. As the coupling is engaged in the afore-mentioned state, the worm 38 also rotates as does the worm gear 40 to lift or lower a load.

In the case of lowering a load, when this itself or a part of the cable pantograph strikes an obstruction, the worm gear 40 no longer exerts a moment in the direction of the arrow 48 on the worm 38 with the consequence that the spring 46 displaces the worm 38 upwardly, on account of which the coupling parts are released. This has the consequence that the rotation of the drive shaft 36 for further lowering the load or the lower part of the pantograph linkage no longer has an effect on a rotation of the worm 38 and thus also no longer has an effect on the rotation of the worm gear 40 and the movement of the cables 22.

A pawl 50 is rotatably supported about an axis 52 on the worm 38. This axis lies axially parallel to the drive shaft 36 and the worm 38 itself. A leaf spring 54 presses the pawl 50 into abutment against the drive shaft 36, for which purpose the pawl 50 is arranged in an open recess 56 of the worm 38. There is located at the axial level of the pawl 50 in the peripheral surface of the drive shaft 36 a recess 58 in the form of a flattening which has a stop 60 for the pawl 50 at one side in such a manner that upon relative rotation of the drive shaft 36 and the worm 38 in the decoupled state and a rotation of the drive shaft 36 in a sense of rotation for lowering the load, the pawl 50 passes in the manner of a ratchet over the stop 60 and, in the opposite sense of rotation, the pawl 50 lies in abutment against the stop 60 so that the worm 38 rotates together with the drive shaft 36.

When the drive shaft 36 is moved again out of the decoupled position to lift the load, the pawl 50 abuts against the stop 60 so that the worm 38 and thus the worm gear 40 rotate in a direction against the arrow 48. With increasing tautness of the cables and the increase in load associated with this, the worm 38 together with its coupling part 42 then becomes coupled with the coupling part 44 so that the drive directly effects a lifting of the load via the cables. In this case, as seen in the peripheral direction, the coupling part 44 and the stop 60 are located on one axial line. However, the coupling engagement is designed such that upon engagement of the coupling, a relative rotation (preferably by 3°) of the drive shaft 36 and the worm 38 results in such a manner that the pawl 50 is released from the stop 60 and a load is thus removed from the pawl 50.

Figure 5A:
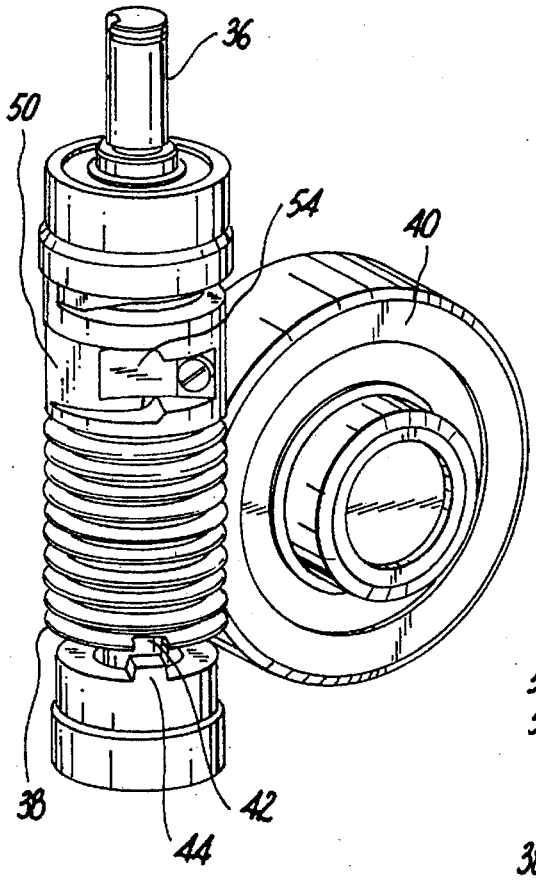
FIGS. 5*a*, and 5*b* show a perspective illustration of a worm gear drive respectively in the decoupled position and the coupled position.
Figure 5B:
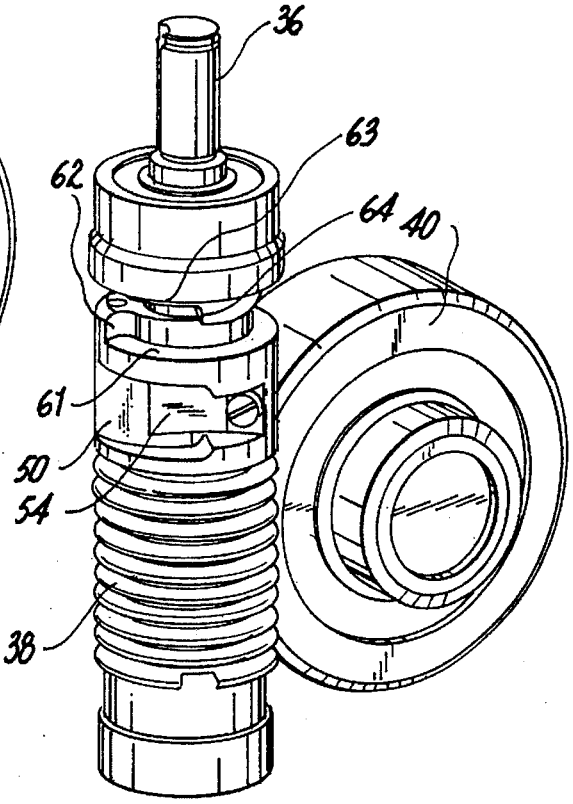
Figure 6:
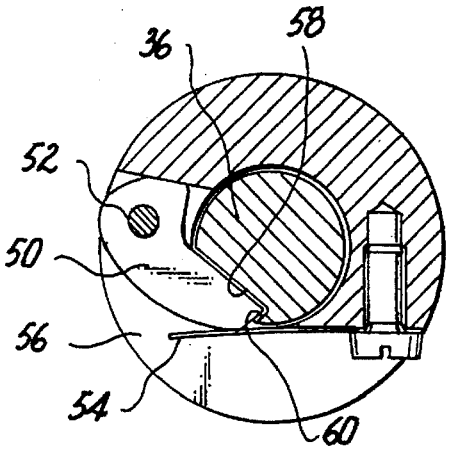
FIG. 6 shows a sectional view along the line 6—6.

As may be particularly seen in FIG. 5*b*, there is a milled out recess 61 at the upper end of the worm 38 which forms a braking stop 62. Above this recess 61 there is a milled out recess 63 on the housing side with a stop 64 also arranged on the housing side in such a manner that, in the position of the worm 38 according to FIG. 5*a*, in other words in the decoupled, upper position, both of the stops abut each other when the drive shaft 36 rotates again after recoupling and takes or rotates with it the worm by means of frictional contact.

So that the abutment of both stops does not take place in too hard a manner, the stop on the side of the housing is dampened in such a manner that it can give way under the effect of a disc spring 66, in other words such that it can slip.

We claim:

1. Lifting apparatus, comprising a carrying part, an actuating part, means (22) for interconnecting said carrying part with said actuating part, said actuating part comprising an actuator element (36), a gear transmission (38, 40) having a drive gear (38) and a driven gear (40) coupled to said drive gear (38), said gear transmission (38, 40) being coupled to said interconnecting means (22) and upon application of load to said carrying part, said driven gear (40) couples said drive gear (38) with said actuator element (36) against a force (46) normally pressing said drive gear (38) and actuator element (36) apart, and upon lifting said carrying part, said actuator element (36) moves into coupling engagement with said drive gear (38), and a positive-locking clutch (42, 44) arranged to couple said drive gear (38) and actuator element (36) in a rotational direction of said actuator element (36) and drive gear (38), wherein said positive-locking clutch (42, 44) comprises a recess (42) on one of said drive gear (38) and actuator element (36) and a complementary protrusion (44) on the other of said drive gear (38) and actuator element (36), said recess (42) and protrusion (44) arranged to interlock in a rotational direction of said drive gear (38) and actuator element (36) upon engagement of said drive gear (38) and actuator element (36), a pawl (50) rotatably supported (52) on one of said drive gear (38) and actuator element (36) and a stop (60) arranged on the other of said drive gear (38) and actuator element (36), said pawl (50) and stop (60) arranged with respect to one another such that upon rotation of said actuator element (36) to lift the load, said pawl (50) abuts said stop (60) and couples said drive gear (38) with said actuator element (36) and upon rotation of said actuator element (36) in the opposite direction, said pawl (50) passes over said stop (60) with said pawl (50) and stop (60) acting in a manner of a ratchet, and said complementary recess (42) and protrusion (44) lie approximately on the same line as said stop (60) in an axial direction along said actuator element (36).

2. The apparatus of claim 1, wherein said complementary recess (42) and protrusion (44) form part of a jaw clutch.

3. The apparatus of claim 1, wherein said interconnecting means (22) comprise a cable (22), and additionally comprising a mechanical pantograph linkage (10) coupling said actuating part with said carrying part.

4. The apparatus of claim 3, additionally comprising at least one cable-hoisting drum (20) coupled to said driven gear (40) which is a worm wheel, said drive gear (38) being a worm and said actuator element (36) being a drive shaft.

5. The apparatus of claim 1, wherein said drive gear (38) comprises a first braking stop (62) and said actuating part comprises a second braking stop (64), both said braking stops (62, 64) being arranged to abut each other when said drive gear (38) and actuator element (36) are decoupled from one another.

6. The apparatus of claim 5, additionally comprising spring means (66) for dampening abutment of said two breaking stops (62, 64) and positioned such that said second breaking stop (64) can give way under the effect of said spring means (66) and slip.

7. The apparatus of claim 1, wherein said actuator element (36) and drive gear (38) are arranged to rotate slightly relatively with respect to one another upon coupling by said clutch (42, 44), such that said pawl (50) is released from said stop (60).

8. The apparatus of claim 1, wherein said recess (44) is provided on said drive gear (38) and said protrusion (44) is provided on said actuator element (36), said pawl (50) is rotatably supported (52) in an open recess (56) on said drive gear (38), said stop (60) is arranged in a recess (58) on a peripheral surface of said actuator dement (36) and additionally comprising a leaf spring (54) arranged on said drive gear (38) to press said pawl (50) into abutment against said actuator dement (36).

9. Lifting apparatus comprising a carrying part, an actuating part, means (22) for interconnecting said carrying part with said actuating part, said actuating part comprising an actuator element (36), a gear transmission (38, 40) having a drive gear (38) and a driven gear (40) coupled to said drive gear (38), said gear transmission (38, 40) being coupled to said interconnecting means (22) and upon application of load to said carrying part, said driven gear (40) couples said drive gear (38) with said actuator element (36) against a force (46) normally pressing said driven gear (38) an actuator element (36) apart, and upon lifting of said carrying part, said actuator element (36) moves into coupling engagement with said driven gear (38), and a positive-locking clutch (42, 44) arranged to couple said drive gear (38) and actuator element (36) in a rotational direction of said actuator element (36) and drive gear (38), wherein said actuating part additionally comprises a bell or socket (24) provided with a transverse pin (26), a drive shaft (28) coupled at an end thereof, without relative rotation, to said bell or socket (24), a belt pulley (30) coupled, without relative rotation, to an opposite end of said drive shaft (28), a drive belt (32) positioned around said belt pulley (30), and an additional belt pulley (34) coupled, without relative rotation, to said actuator element (36) and about which said drive belt (32) is also positioned.

10. Lifting apparatus comprising a carrying part, an actuating part, means (22) for interconnecting said carrying part with said actuating part, said actuating part comprising an actuator element (36), a gear transmission (38, 40) having a drive gear (38) and a driven gear (40) coupled to said drive gear (38), said gear transmission (38, 40) being coupled to said interconnecting means (22) and upon application of load to said carrying part, said driven gear (40) couples said drive gear (38) with said actuator element (36) against a force normally pressing said drive gear (38) an actuator element (36) apart, and upon lifting of said carrying part, said actuator element (36) moves into coupling engagement with said driven gear (38), and a positive-locking clutch (42, 44) arranged to couple said drive gear (38) and actuator element (36) in a rotational direction of said actuator element (36) and drive gear (38), wherein said positive-locking clutch (42, 44) comprises a recess (42) on one of said drive gear (38) and actuator element (36) and a complementary protrusion (44) on the other of said drive gear (38) and actuator element (36), said recess (42) and protrusion (44) arranged to interlock in a rotation direction of said drive gear (38) and actuator element (36) upon engagement of said drive gear (38) and actuator element (36), additionally comprising a pawl (50) rotatably supported (52) on one of said drive gear (38) and actuator element (36) and a stop (60) arranged on the other of said drive gear (38) and actuator element (36), said pawl (50) and stop (60) arranged with respect to one another such that upon rotation of said actuator element (36) to lift the load, said pawl (50) abuts said stop (60) and couples said drive gear (38) with said actuator element (36) and upon rotation of said actuator element (36) in the opposite direction, said pawl (50) passes over said stop (60) with said pawl (50) and stop (60) acting in a manner of a ratchet, wherein said complementary recess (42) and protrusion (44) lie approximately on the same line as said stop (60) in an axial direction along said actuator element (36), said interconnecting means (22) comprise a cable (22), and additionally comprising a mechanical pantograph linkage (10) coupling said actuating part with said carrying part, at least one cable-hoisting drum (20) coupled to said driven gear (40) which is a worm wheel, said drive gear (38) being a worm and said actuator element (36) being a drive shaft, and wherein said actuating part additionally comprises a bell or socket (24) provided with a transverse pin (26), a second drive shaft (28) coupled at an end thereof without, relative rotation, to said bell or socket (24), a belt pulley (30) coupled, without relative rotation, to an opposite end of said second drive shaft (28), a drive belt (32) positioned around said belt pulley (30), and an additional belt pulley (34) coupled, without relative rotation, to said first drive shaft (36) and about which said drive belt (32) is also positioned.

* * * * *